United States Patent [19]

de Vries

[11] 4,314,494

[45] Feb. 9, 1982

[54] ELECTRIC KEYBOARD MUSICAL INSTRUMENT

[76] Inventor: Paul de Vries, 38 W. 10th St., New York, N.Y. 10011

[21] Appl. No.: 95,558

[22] Filed: Nov. 19, 1979

[51] Int. Cl.[3] ..... G10H 3/00

[52] U.S. Cl. ..... 84/1.06; 84/236; 84/237

[58] Field of Search ..... 84/1.06, 236, 237

[56] References Cited

U.S. PATENT DOCUMENTS

| | | | |
|---|---|---|---|
| 591,887 | 10/1897 | Schweikart | 84/237 |
| 2,641,153 | 6/1953 | Enochs | 84/236 |
| 3,270,608 | 9/1966 | Rhodes | 84/237 |
| 3,334,172 | 8/1967 | Markowitz et al. | 84/1.06 |

FOREIGN PATENT DOCUMENTS

| | | | |
|---|---|---|---|
| 13129 | 4/1903 | Austria | 84/237 |

*Primary Examiner*—Monroe H. Hayes

*Attorney, Agent, or Firm*—Curtis, Morris & Safford

[57] ABSTRACT

A portable electric keyboard musical instrument is disclosed which includes (1) a two-part folding supporting structure, (2) a plurality of vibratile reeds with each having an end fixedly attached to the supporting structure, and (3) a plurality of actions for selectively causing respective reeds to vibrate. Each action is supported on the supporting structure and associated with one of the reeds. Each action also includes a hammer assembly for selectively striking one of the reeds and an escapement assembly for initiating the striking action of the hammer associated therewith and to control its motion thereafter until reactivated. A plurality of keys are provided each associated with one of the actions for actuating its hammer assembly so as to strike its respective reed. A pickup device is used in spaced relation to the reeds for generating an electrical frequency from the vibrations of the reeds. The action is a modified Viennese action characterized in one particular by the elimination of a pin axle and by the use of a resilient hinge.

11 Claims, 9 Drawing Figures

20
38
18
24
52
50
44
48
32
110
36
112
114
118
34
86
120
22
130
84
42
40
76
74
66
68
70
26
108
106
30
104
102
96

20
18
24
52
50
44
32
110
36
112
34
86
118
120
42
84
22
130
40
76
74
66
68
70
26
108
106
30
104
102
96

ELECTRIC KEYBOARD MUSICAL INSTRUMENT

This invention relates generally to electric keyboard musical instruments and, more particularly, it is directed to an improved electric keyboard musical instrument of the struck-reed type which is hand-transportable.

BACKGROUND OF THE INVENTION

As far as it is known prior efforts to make portable keyboard musical instruments of the struck-reed type have resulted in instruments which are not easily carried about. Such prior instruments weigh at least 70 pounds and have a minimum rigid length for four octaves of at least 30 inches. As such they are not truly hand transportable keyboard musical instruments which can readily be carried about by travelers, students and the like.

OBJECTS AND SUMMARY OF THE INVENTION

Accordingly, it is an object of the present invention to provide an electric keyboard musical instrument which is of relatively simple construction, and which is portable and lightweight.

More particularly, it is an object of the invention to provide an electric keyboard musical instrument of the struck-reed type which utilizes a plurality of reeds as the musical tone generators.

Another object is to provide an electric keyboard musical instrument which provides an adaption of a Viennese action mechanism in conjunction with a plurality of reeds.

In accordance with one aspect of this invention, an electric keyboard musical instrument includes supporting means, a plurality of vibratile reeds, each having an end fixedly attached to the supporting means, and a plurality of actions for selectively causing the reeds to vibrate, each being supported on the supporting means and each associated with a particular reed.

The present invention includes an action similar to the Viennese-type action. However, it differs from that action in several ways. The present action includes a key, a key balance mounting assembly, a guide block, an escapement and a hammer. The action is used in cooperation with a vibratile reed which is supported on a supporting structure and a pick-up assembly that is positioned adjacent to the free end of the reed. The depression of the key raises the hammer towards the reed against the restraint of the escapement. Upon striking the reed the hammer having moved out of the restraint of the escapement in essence bounces off the reed and falls back by gravity to its rest position where it is once again controlled by the escapement until the key is again depressed.

By the use of a resilient, biased hinge between the hammer assembly and the key the necessity of a check device is eliminated. Advantageously the hinge is made of a flexible, yet resilient material having sufficient memory to return to its original at rest condition. Polypropylene is such a material. The resilency of the hinge prevents the falling hammer from bouncing upwardly after hitting the key and restriking the reed to give an unwanted sound, this function being performed by a check device in Viennese-type actions.

Similar hinges are used between the hammer and the key and the escapement and the supporting base of the instrument.

A guide block having a restricted opening for the end of the key adjacent to the escapement is also provided and it serves not only to guide the key in its vertical movement, but also advantageously to prevent lateral movement. This feature coupled with the unique hinge arrangement insures that the action will not be damaged or forced out of proper adjustment when the instrument is folded for storage or transporting.

The present invention uses the modified Viennese action with struck reeds and as presently understood this has not been done heretofore, even with a classic Viennese action. Further, resilent hinges are used instead of traditional pin axles and the key balance rail and pin is replaced by a cantilevered key balance and key alignment mounting. No escapement retaining spring is required due to the use of the resilent hinge and an escapement adjustment is provided on the hammer tail assembly.

As mentioned previously no check device is required.

The above, and other, objects, features and advantages of the invention, will be apparent in the following detailed description of the illustrative embodiment typical of the invention which is to be read in conjunction with the accompanying drawings.

DETAILED DESCRIPTION OF THE PREFERRED EMBODIMENT

Figure 1:
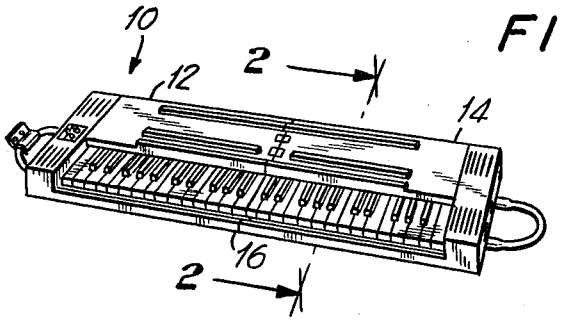
FIG. 1 is a perspective view of one illustrated electric keyboard musical instrument according to the present invention.

Referring to the drawings in detail, and initially to FIG. 1, it will be seen that an electric keyboard musical instrument 10 according to the present invention is shown. The instrument 10 is advantageously formed from two basic units 12 and 14 which are foldable along a hinge line 16 so that the instruments will be easily transportable by hand. These and other features relating to the protection and portability of the instrument are more fully described in my related and copending application entitled "Portable Securing Assembly For An Electric Musical Keyboard Instrument", which is filed concurrently with this case and the contents thereof are incorporated herein by reference to it.

Figure 2:
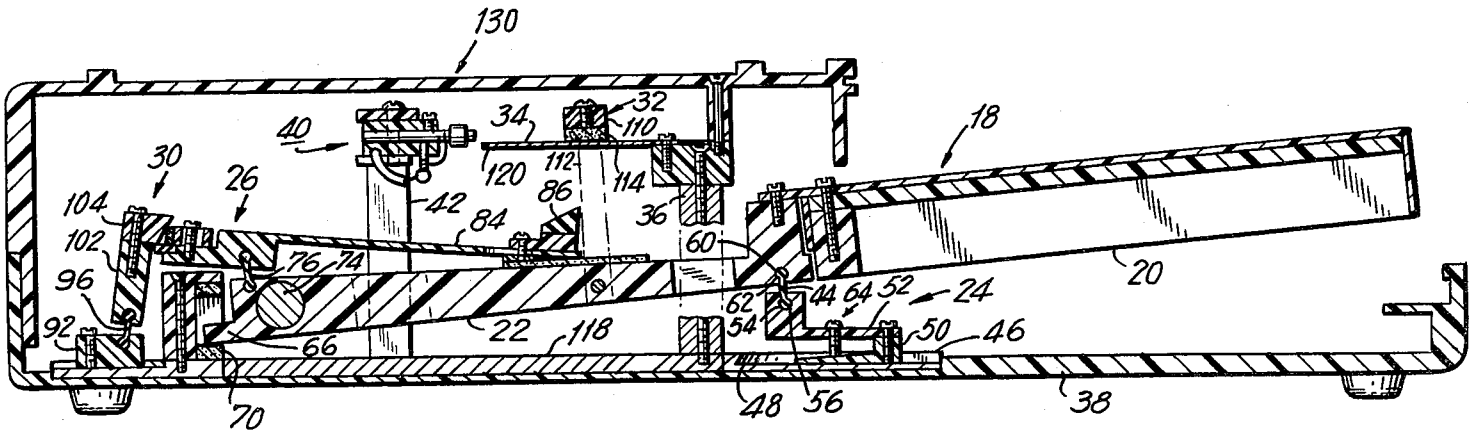
FIG. 2 is a cross-sectional view of the electric keyboard musical instrument of FIG. 1 taken along lines 2—2.
Figure 2A:
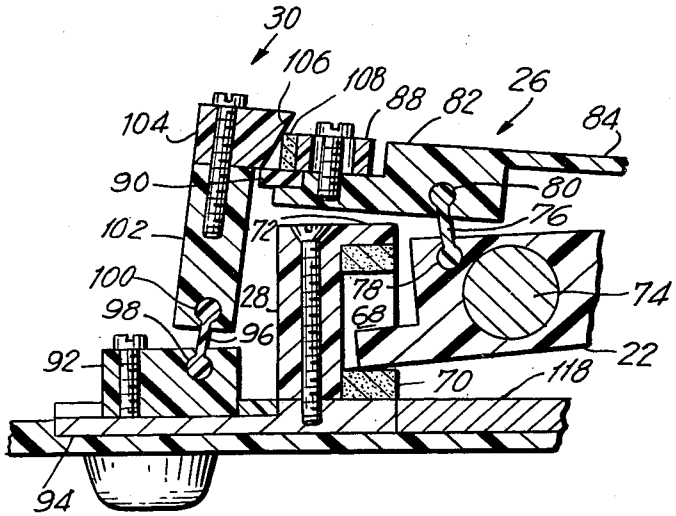
FIG. 2*a* is an enlarged fragmentary view of that portion of FIG. 2 showing the details of the interaction of the escapement guide block hammer assemblies.
Figure 3:
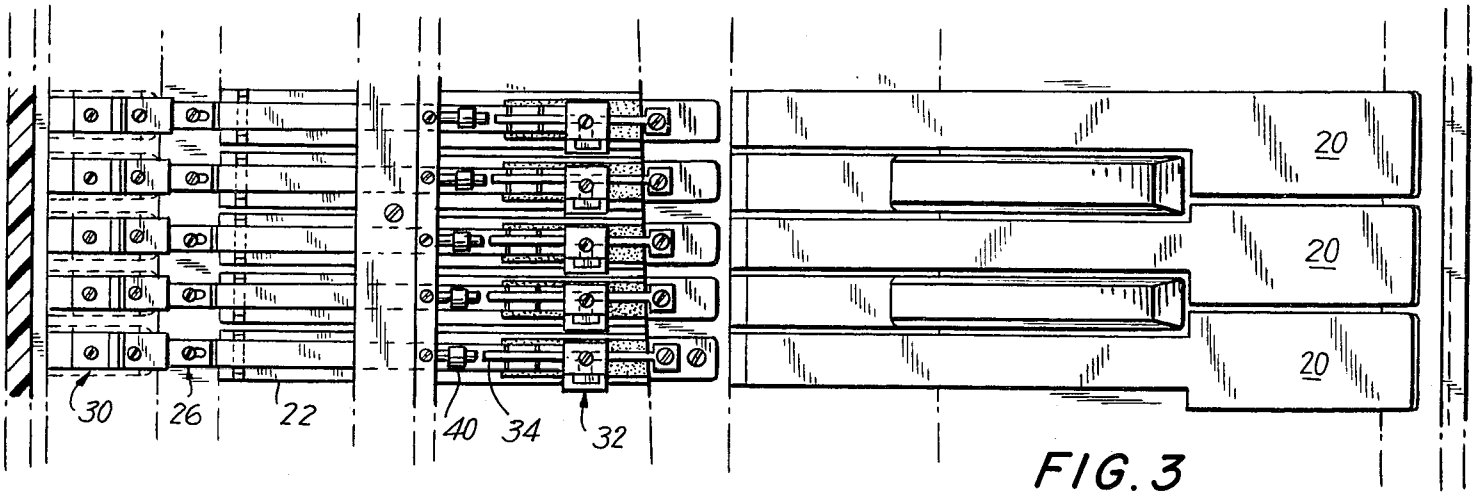
FIG. 3 is a partial top plan view of several keys and associated mechanisms of the instrument of FIG. 2.

Referring to FIGS. 2, 2*a* and 3 in particular, the interrelation of the action, reed and pickup assembly may be readily understood. The action is comprised of a key 18 having a head 20 and a tail 22, a key balance mounting assembly 24, a hammer assembly 26, a guide block 28, an escapement 30 and a damper 32. The reed 34 is mounted on a member 36 which is securely affixed to a supporting structure 38. The pickup assembly 40 is positioned adjacent to the reed 34 and mounted on a member 42 which is also affixed to the supporting structure 38.

The key 18 is connected to the key balance mounting assembly 24 by means of a flexible hinge 44 which preferably has good memory properties and will not become deformed under repeated use. One material which may be used is polypropylene. The hinge 44 is made with an enlarged section at each end and mounted in fitting grooves on the key 18 and the mounting assembly 24. The mounting assembly is affixed to the supporting structure 38 thus holding the hinge in place so that an accurate fixed fulcrum point is provided for the key.

Figure 4:
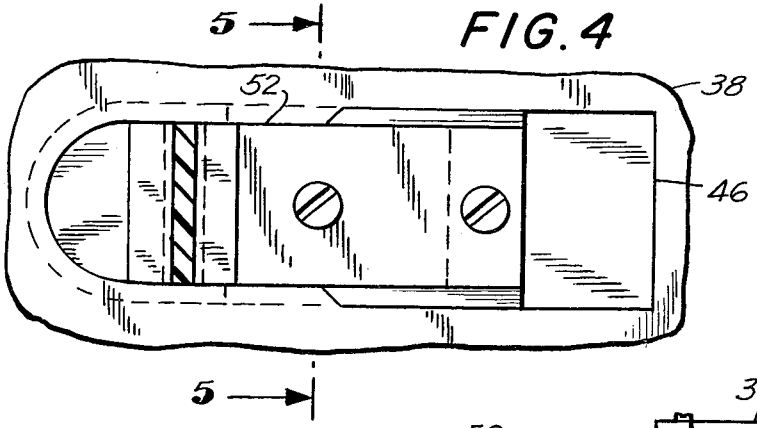
FIG. 4 is a fragmentary top plan view of a key balance support of the instrument of FIG. 2.
Figure 5:
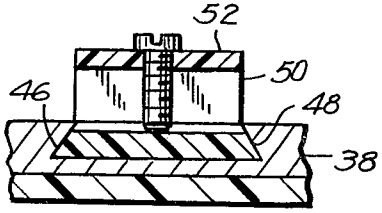
FIG. 5 is a cross-sectional view of the key securing member of FIG. 4, taken along lines 5—5.

As shown in FIGS. 2, 4 and 5 the key balance mounting assembly comprises a base 46 which is slidably adjustable in a slotted keyway 48 in the supporting structure 38. A post member 50 extends from the base 46 and from it a cantilever 52 projects forwardly. A groove 54 is provided in the cantilever into which is fitted the enlarged portion 56 of the hinge 44. The web of the hinge 44 is joined to a second enlarged portion 60 which is similarly fitted into a groove 62 in the key 18. This hinge replaces the key balance pin in conventional keyboard actions and acts as a fulcrum for the key.

In conventional systems the key is usually cushioned and pivoted upon a soft felt washer which encircles the balance pin and rests between the bottom of the key and the supporting base or rail. Vertical alignment of the keys, one to another, is accomplished in the conventional system by means of shims of various thicknessess. They are usually made of cardboard or paper and in the form of washers.

The key balance mounting assembly of the present invention performs the functions of the washers, shims and pin by different means and with added benefits and functions. The assembly securely anchors the key to the supporting structure to assure its alignment with the other keys after the instrument is folded and in portable use. With the balance pin felt construction the soft felt achieves a set and if displaced by an instrument being folded or transported, the washer may not return to its initial position, thus throwing the keys out of alignment. Further the free hanging keys would be free to ride up and down on the pin and may be damaged.

The hinge 44 is advantageously designed so that the free extent of the web between the grooves 54 and 62 is kept to a minimum. An extent of about 1/10 of an inch would normally be acceptable. The exact extent will depend upon the construction of the related members.

The cantilever 52 acts to cushion the force applied to the head 20 of the key, as a shock absorber. This is achieved by having the cantilever formed of a normally rigid yet resilient material. The cantilever 52 may be set for proper bias and key head height by means of adjustment screw 64.

The key 18 is comprised of the tail 22 and the head 20. The head may be formed from a molded piece having a dove tail at its end adjacent to the tail where it fits into a mating joint. Preferably the hinge groove 62 is in the tail 22 and adjacent the mating joint so as to provide a good fulcrum point.

The tail 22 extends from the fulcrum point to the guide block 28. A flange member 66 extends from the tail and is inserted into opening 68 in the guide block 28. The opening 68 is of limited lateral extent of only slightly greater width than the flange 66. This limited lateral width serves to cooperate with the hinge 44 and the key balance mounting assembly 24 to keep the key 18 in alignment.

Shock absorbing material 70 is placed in both the upper and lower portions of opening 68 so as to cushion the flange when the head of the key is struck and due to the pivot action of the hinge 44 the flange is rotated upwardly. The upward extent of the movement of the flange 66 is limited by the upper rail 72 of the guide block 28.

To return the tail 22 to an at rest position as shown in FIG. 2, weights 74 are inserted into the tail 22. Mounted on the tail 22 adjacent the flange 66 is a hammer hinge 76. This hinge is also preferably made of a resilient and flexible material such as polypropylene. The hinge 76 is fitted into a groove 78 in the tail and a second groove 80 in the hammer assembly and is the means by which the key and hammer assembly are connected together.

The hammer assembly 26 includes a hammer tail 82 in which the groove 80 is formed. Extending from the hammer tail 82 is the hammer shaft 84 and at the end of it is the hammer head 86. Also extending from the hammer tail 82 and away from the shaft 84 is an escapement adjustment block 88 under which is mounted a tooth 90. The tooth 90 may be made of a stiff but resilient material and it is mounted on the hammer tail independently of the escapement adjustment block 88.

Adjacent the guide block 28 and secured to the supporting structure 38 is an escapement support block 92 which is advantageously adjustably fitted into a guideway 94 in the structure 38. An escapement hinge 96, similar to the hinge 44 and the hammer hinge 76, is mounted in a groove 98 in block 92 and in a groove 100 in the escapement post 102. Mounted on the post 102 is the escapement head 104. The head has an inclined face 106 which contacts and is urged against the escapement adjustment block 88 by the resiliency of the escapement hinge 96 when the key is in the at rest position of FIG. 2.

The escapement adjustment block 88 has attached to it an escapement damper 108 preferably in the form of a felt. The escapement damper 108 contacts the face 106 of the head 104.

The escapement adjustment block 88 may be moved as desired on the hammer tail so as to adjust the position of the escapement head with respect to the hammer tooth 90 which lies under it.

Figure 6:
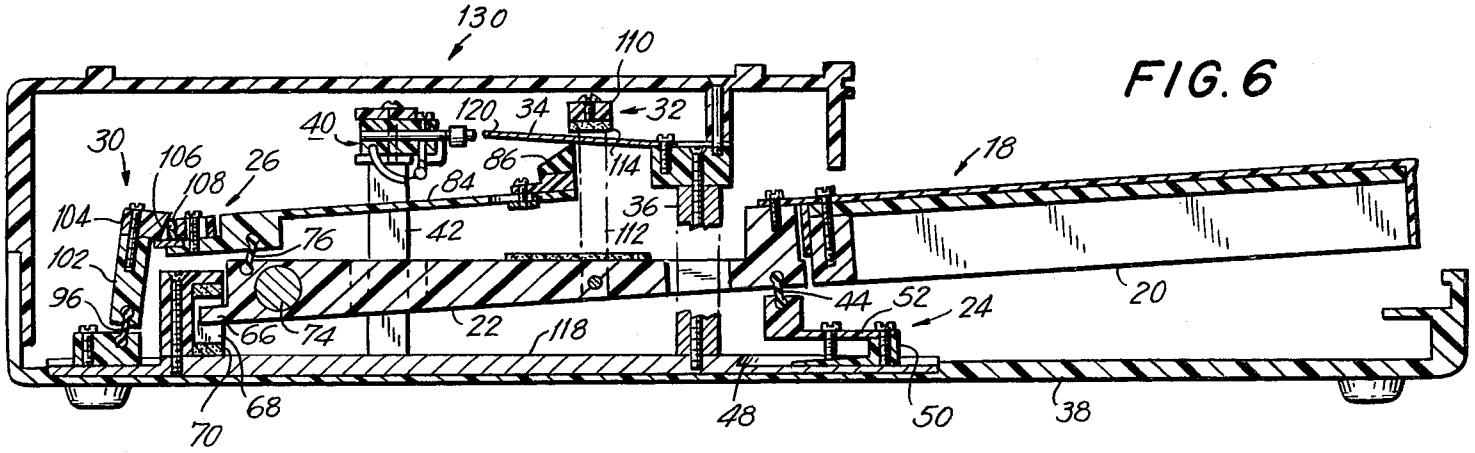
FIG. 6 is a sectional view of the instrument of FIG. 2, in a first action position.
Figure 7:
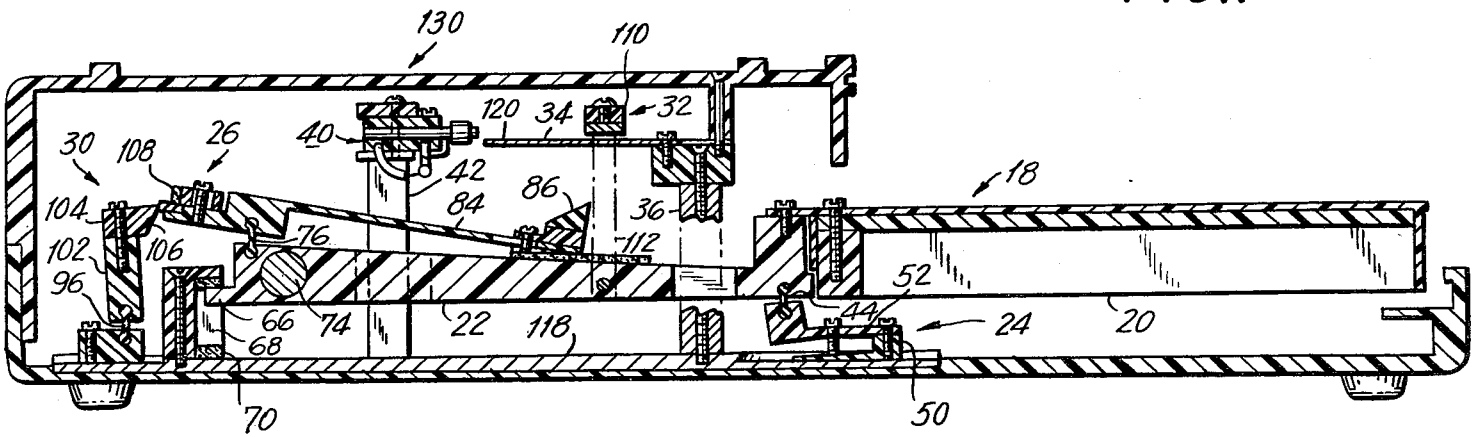
FIG. 7 is a sectional view of the instrument of FIG. 2, in a second action position.

The tooth 90 normally engages the lip or underside of the escapement head. When the key head is depressed and the key tail rotated about hinge 44, the tooth being momentarily restrained by the bottom lip of the escapement head 104 causes the hammer to rotate about the hammer hinge 76. This results in the hammer head 86 striking the reed 34 as shown in FIG. 6 and the tooth in the same motion also pushes back the escapement head so that the biased pressure of the hammer hinge 76 controls the hammer, assuring its return to an at rest position against the key trail as shown in FIG. 7.

By varying the resistance of the tooth to the escapement head by means of the position of the escapement adjustment block 88, the velocity of the escaped force of the hammer against the reed is controlled. This in turn controls the amplitude of the sound. The sharpness of the striking of the reed by the hammer is enhanced by the design of the hammer shaft. The hammer shaft is preferably slender and rigid when at rest. It is also resilent and flexible under a load so that it has a whip-like action when the hammer is released from the escapement.

The escapement hinge 96 not only acts as a hinge or pivot but due to its resiliency it also biases the escapement head into engagement with the hammer.

The adjustment of the resistance of the tooth to the escapement head to control the amplitude of sound is called "voicing". In the present invention this is accomplished by use of the biasing effect of the hinges and the adjustment on the hammer tail by means of the escapement adjustment block in conjunction with adjustment of the position of the hammer head on the hammer shaft and the position of the pickup in relation to the end of the reed.

After the reed is struck by the hammer and as long as the key remains depressed the reed is free to vibrate until dampened, or until stilled by loss of inertia. Damping is accomplished by means of the damper 32 which includes a head 110, a support 112 and a cushion 114. The support is affixed to the key tail and in the at rest key position as shown in FIG. 2 the head 110 with its cushion 114, normally made of felt, rests on the reed 34 preventing it from vibrating. However, when the key head 20 is depressed, as shown in FIGS. 6 and 7, the raising of the key tail 22 lifts the damper upwardly so that the head 110 and cushion 114 is free above the reed.

The reed 34 is affixed as a cantilever to the post 36. The post 36 is in turn supported on a substantial base plate 118 and the post is rigidly held in a fixed position on it. The base plate 118 is advantageously a separate member from the key balance mounting assembly 24 and the guide post 28. While the plate 118 is contained within supporting structure 38, the plate can support the post 36 independently of the structure. Because the reed and the pickup assembly are mounted on the substantial plate good acoustical and sound quality is obtained while still reducing the weight of the instrument since the plate is of limited extent.

Figure 8:
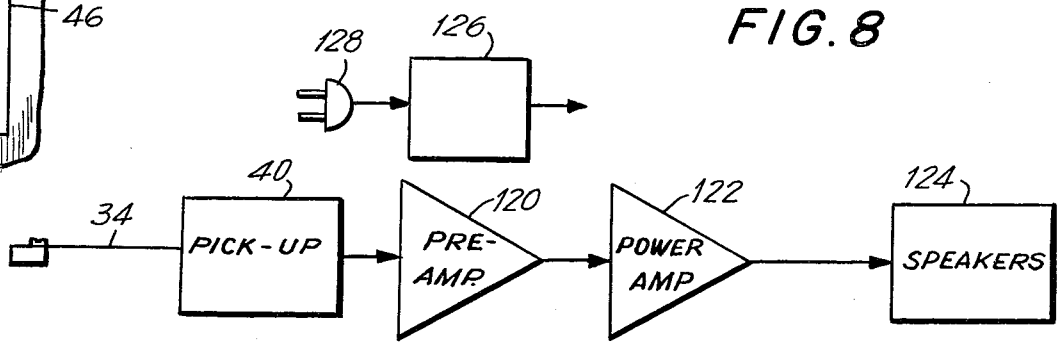
FIG. 8 is a circuit block diagram of the electrical circuit of the electric keyboard instrument of FIG. 1 and its association with the reeds thereof.

Each reed has a free end 120 and extends from the post 36. By varying the length of a reed or its weight, each may be adapted to vibrate at a different frequency. Adjacent the free end of each reed is a pickup assembly 40. The pickup is disposed in a spaced relation to the end of the reed so as to generate an electrical frequency from the vibration of the reed. Preferably, a pickup is provided for each reed. As a result when a reed is vibrated by being struck with the hammer as described previously, the pickup assembly transduces the vibrations into an electrical frequency which is supplied to an amplifier system. As shown in FIG. 8 such a system would include a pre-amplifier 120 and a power amplifier 122, and speaker 124. Such a system will produce audible tones reflecting which selected keys have been struck by the instrument user.

Operating power to the instrument and the amplifier system in particular may be supplied by any suitable means, such as a rechargeable battery 126 and/or conventional AC power supply 128 which may be used directly or through the battery.

The number of actions and associated reeds and pickup devices will be determined by the desires of each manufacturer. As a practical matter sufficient devices should be combined to provide a range of four octaves.

In order to obtain the optimum total quality from the instrument each hammer head is adjustable to permit the head to strike the reed at a selected nodal point and to suppress unwanted enharmonic frequencies. This can be accomplished by moving the head to selected points on the hammer shaft until the desired point is reached. The pickup coil is also adjustable to obtain optimum pickup by varying the distance from the end of the reed to the pickup.

The upper portion 130 of the supporting structure 38 is preferably removeable so that access to the components of the instrument may be readily obtained.

Because of the combination of the various lightweight action features as described previously, the reeds are preferably of lighter weight and lesser length than would be the case with other actions, providing greater sensitivity of response.

What is claimed:

1. An electric keyboard musical instrument comprising:

supporting means;

a plurality of vibratile reeds, each having a free end and its other end fixedly attached to the supporting structure;

a plurality of actions, each being associated with a reed;

each action including a key having a head and a tail, a hammer assembly including a hammer mounted on the key tail, an escapement, and flexible and resilent key hinge means for connecting the key to the supporting structure;

said hammer assembly connected to the tail of the key by hinge and biasing means and when at rest in contact with the escapement and initially restrained thereby, whereby when the key head is depressed the key tail rotates about the key hinge causing the hammer assembly to overcome the resistance of the escapement so that the hammer strikes the reed at a specific point causing it to vibrate;

pickup means in spaced relation to the free end of the reed for generating an electric oscillation signal from the vibrating reed.

2. An electric keyboard musical instrument as defined in claim 1 wherein the escapement includes a resilent hinge member and an escapement head, said head being biased into contact with the hammer assembly by said hinge action.

3. An electric keyboard musical instrument as defined in claim 2 wherein said hammer assembly includes a tooth extending from said hammer assembly and underlying the escapement head, the extent of the tooth beneath the escapement head determining the resistance force exerted on the hammer assembly by the escapement.

4. An electric keyboard musical instrument as defined in claim 3 and further including an escapement adjustment block mounted on the hammer and overlying the tooth and moveable to a plurality of positions to vary the extent of the tooth beneath the escapement head.

5. An electric keyboard musical instrument as defined in claim 3 wherein said hammer assembly further includes:

a hammer tail from which the tooth extends and to which the hammer hinge is connected, a hammer shaft extending from the hammer tail, and a hammer head on said shaft and positioned beneath the reed, whereby the hammer head strikes the reed when the key head is depressed.

6. An electric keyboard musical instrument as defined in claim 1 wherein the key hinge means includes a key balance assembly means and the flexible and resilent hinge is connected to the assembly means and to the key, said assembly means being connected to the supporting structure whereby said hinge acts as a fulcrum for the rotation of the key tail when the key head is depressed.

7. An electric keyboard musical instrument as defined in claim 6 wherein the assembly means includes a cantilever member and adjustment means for positioning the free end of the cantilever with respect to the supporting structure, and the hinge being connected to the assembly means in said cantilever member.

8. An electric keyboard musical instrument as defined in claim 1 wherein the key tail includes a portion thereof extending into an opening in a guide block, said guide block being connected to the supporting structure, and said opening limiting the lateral movement of the key tail and its extent of rotation upon depression of the key head, and said opening and the key hinge means cooperate to aid in the maintenance of the key alignment when the instrument is moved from normal operating position.

9. An electric keyboard as defined in claim 8 and further including a cushion material within said opening to absorb the force of the key tail rotation.

10. An electric keyboard musical instrument as defined in claim 1 and further including a damper means mounted on the key tail and in contact with the reed to prevent vibration thereof when the key is in a normal at rest position, and being rotated out of contact with said reed when the key head is depressed and before the hammer strikes the reed.

11. An electric keyboard musical instrument as defined in claim 1 wherein the pickup means is adjustably positionable with respect to the free end of the reed.

* * * * *